United States Patent [19]

Parant

[11] Patent Number: 4,842,081

[45] Date of Patent: Jun. 27, 1989

[54] SIMULTANEOUS DRILLING AND CASING DEVICE

[75] Inventor: Jean P. Parant, Bizanos, France

[73] Assignee: Societe Nationale Elf Aquitaine (Production), Courbevoie, France

[21] Appl. No.: 198,462

[22] Filed: May 18, 1988

Related U.S. Application Data

[63] Continuation of Ser. No. 32,856, Mar. 31, 1987, abandoned.

[30] Foreign Application Priority Data

Apr. 2, 1986 [FR] France ..... 8604678

[51] Int. Cl.[4] ..... E21B 7/20

[52] U.S. Cl. ..... 175/23; 175/101; 175/171; 175/173; 175/257

[58] Field of Search ..... 175/22, 23, 92, 100, 175/101, 103, 107, 106, 171, 173, 257, 321; 166/71, 381, 380

[56] References Cited

U.S. PATENT DOCUMENTS

| | | | |
|---|---|---|---|
| 3,732,143 | 5/1973 | Joose | 175/171 |
| 3,958,648 | 5/1976 | Gronblad | 175/23 |
| 4,183,415 | 1/1980 | Stenuick | 175/257 |
| 4,343,370 | 8/1982 | Chatard et al. | 175/107 |
| 4,361,194 | 11/1982 | Chow et al. | 175/107 |
| 4,544,041 | 10/1985 | Rinaldi | 175/171 |

FOREIGN PATENT DOCUMENTS

| | | | |
|---|---|---|---|
| 778289 | 2/1968 | Canada | 175/171 |
| 888083 | 8/1953 | Fed. Rep. of Germany . | |
| 1187567 | 2/1965 | Fed. Rep. of Germany . | |
| 1247985 | 8/1967 | Fed. Rep. of Germany . | |
| 2421356 | 9/1975 | Fed. Rep. of Germany . | |
| 2165283 | 4/1986 | United Kingdom | 175/171 |

OTHER PUBLICATIONS

"Method Speeds Conductor Setting Operation", World Oil, vol. 187, No. 1, Sep. 1978 (p. 82).

*Primary Examiner*—Bruce M. Kisliuk

*Attorney, Agent, or Firm*—Poms, Smith, Lande & Rose

[57] ABSTRACT

In well drilling, and in particular the horizontal drilling field, a simultaneous drilling and casing device is provided. A drill string driven in rotation by a revolving table has at its end a drilling tool 28 driven by a bottom motor 22 and, in its intermediate part, a drive connection 10 to which the rear end 1*a* of a casing section 1 is screwed, whose front end is provided with an abrasive material ring 3. The length of the part of the drill string separating the connection 10 from tool 28 is substantially equal to the length of section 1. The casing 1 driven by the drill string at the speed of rotation of the revolving table cuts its own way during the drilling.

6 Claims, 1 Drawing Sheet

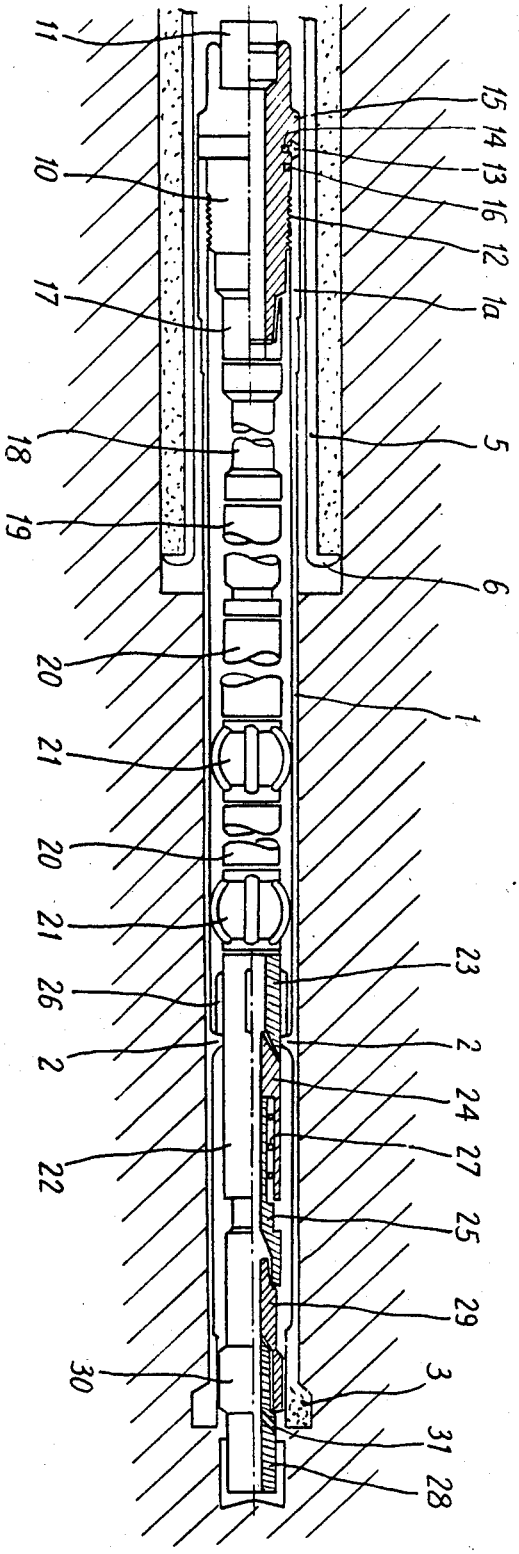
11
10
17
18
19
20
21
20
21
26
2
22
30
15
14
13
16
12
1a
5
6
1
23
2
24
27
25
29
3
31
28

SIMULTANEOUS DRILLING AND CASING DEVICE

This is a continuation, of application Ser. No. 032,856, filed Mar. 31, 1987, now abandoned.

The present invention relates to a simultaneous drilling and casing device.

In the usual oil well drilling methods, drilling is carried out to a certain depth, then the casing is lowered which is anchored to the ground by the injection of cement.

However, if, in the meantime a cave-in occurs, the casing cannot find its position in the drilling hole.

Simultaneous drilling and casing methods are already known, in which the particular arrangement of the drilling string and of the tool allows a hole to be drilled sufficient for placing the casing using a single drilling tool.

However, even in the case of drilling and simultaneous positioning of the casing, the risk of cave-in in unstable ground exists in the gap separating the drilling tool and the lower end of the casing.

In any case, known methods are not adapted to horizontal drilling.

The aim of the present invention is to overcome these drawbacks by providing a method relative to the simultaneous placing of the casing as the drilling advances, by providing the end of the casing with a drilling assembly which makes its way itself, since it is driven in rotation.

The simultaneous drilling and casing device of the invention, which may be used after positioning a first casing section, either using conventional means, or using the present device, followed by cementing, over a part of the well already drilled is characterized in that the drill string, rotated by the revolving table and provided with hollow drill rods, has at its lower end a drilling tool driven by a bottom motor and, in its intermediate part, a drive section with which the rear end of a casing section is secured by screwing, the front end of said section being provided with an abrasive material ring, the length of the part of the drill string separating the drive connection of the drilling tool being substantially equal to the length of the casing section.

In fact, by dissociating the action of the drilling controlled by a bottom motor rotating at speeds of the order of 400 rpm from the annular drilling action provided by an abrasive material ring carried by the end of the casing section and which is driven at the speed of the revolving table, rotating from 40 to 60 rpm, satisfactory results are obtained by controlling the problem of jamming in unstable ground.

BRIEF DESCRIPTION OF THE DRAWING

Other features of the invention will be clear from the following description of one embodiment given by way of example and illustrated by a Figure showing in elevation a portion of a drill string of the invention and in which the drive connection and the part of the bottom are shown in partial section (right hand side).

DETAILED DESCRIPTION OF THE INVENTION

The drill string includes, as is well known, hollow drill rods which are driven by means of the revolving table. Such a drill string, not shown, has at its end a drive connection 10 made from soft steel to which it is fixed by the end 11 of said connection.

The central part of connection 10 has an external thread 12. On this thread is screwed the rear part 1a of a casing section 1 having an internal thread. The rear part 1a has, for reasons of strength, a thickness greater than that of the remaining part of section 1.

Above thread 12 is mounted a hard steel ring 13 fixed to the connection by means of a pin 14. This ring bears on a shoulder 15 formed in the upper part of the connection. Between ring 13 and thread 12 is provided a seal 16.

At the lower end of connection 17 is screwed a hollow rod 18, which is in its turn connected to a telescopic jar 19.

Jar 19 is followed by two drill collars 20. At the end of each drill collar is inserted a short hollow rod covered by a hard rubber sleeve 21 of sufficiently large diameter to allow centering and torque transmission in favor of the casing rotating at the same speed as the drill string.

To the end of the last hollow rod having a sleeve 21 is screwed a bottom motor 22 rotated by a hydraulic fluid flowing through the hollow rods of the string and comprising, in order, an upper stator part 23, a stator 24 and a rotor 25. The upper part 23 has a ring of longitudinal ribs 26 serving as abutments. In fact, when the casing section 1 is correctly screwed onto connector 10, the projecting parts of said ribs 26 bear on an internal shoulder 2 with which the casing section 1 is provided at this level.

The stator 24 and rotor 25 have a ball bearing 27 therebetween.

To the rotor 25 is fixed a drilling tool 28 through the upper part 29 of the tool.

The central part of the drilling tool 28 includes a bronze centering ring 30, free to rotate and whose outer diameter is less by only a few tenths of a millimeter than the internal diameter of the casing.

The front end of the casing section 1 has an abrasive material ring 3.

Rotor 25 is provided with concentrically spaced vents 31 which are intended for the flow of hydraulic fluid in front of ring 3 so as to disengage the working face.

The distance separating connector 10 from the drilling tool 28 is calculated so that, when screwing of part 1a of section 1 is correctly carried out, the projecting parts of ribs 26 bear on the shoulder 2, ring 30 is at the level of ring 3 and the distance between the end of ring 3 and that of tool 28 assumes a predetermined value.

Such a result is promoted by the existence of the telescopic jar 19. In fact, when the projecting parts of ribs 26 abut prematurely against shoulder 2, before correct screwing of the casing is attained, the length of the drill string may decrease, through the action of the jar. Jars are members currently used in oil drilling. They consist of two telescopic tubes fitted one in the other, sealing being provided by adequate seals.

Thread 12 is subjected to considerable stresses during the operation of rotating the casing. Since there exists a danger of deformation of the soft steel connection, a hard steel ring is placed against the shoulder of this connection so as to reduce the risk of such deformation.

The drive connection 10 is a cylindrical connection of a safety joint whose application is conventional in the drilling field. This cylindrical connection can be unscrewed with a smaller torque than that for the conical connection by means of which the drill rods are connected together. Thus, by exerting a rotational torque in the reverse direction to the direction applied during drilling, the casing may be disengaged from the connection, without the connection of the rods being affected.

The bronze ring 30 has an important role. In fact, with the tool driven by the rotor rotating at about 400 rpm and the ring rotating at about 40/60 rpm, it is important that there be no direct contact between the two and that the ring does not damage a part of the drilling tool.

The take up of the torque by sleeves 21 cancels out the reactive torque of the stator 24 which is exerted in the opposite direction to that of the rotation of the rotor.

The method of using the device described is as follows.

With a part of the well already drilled and a casing section 5 ending in a shoe 6 positioned and cemented, the casing section 1 is lowered into the drill hole and the drill string is assembled at the surface.

The new casing section 1 will have a diameter less than that of section 5 already positioned and a drive connection 10 is fitted accordingly.

To the last element of the drill string is fixed said connection 10, then all the elements of the drill string are fixed to the connection, such as the drill rod 18, jar 19 in the elongate position, the drill collars 20 followed by sleeves 21, the bottom motor 22 and the drilling tool 28. The thus assembled string is lowerd inside casing 1 and the rear part 1*a* of casing 1 is screwed onto the thread 12 of connection 10.

Because of the existence of jar 19, it is known that when a certain force has been exerted, sufficient for ensuring correct fixing of the casing on the connection, the projecting parts of the ring with longitudinal ribs 26 have come to bear on the inner shoulder 2 of the casing and that the end of ring 3 is above the end of tool 28 at a good distance, for example 20 cm.

When the drilling is finished, with the drilling depth corresponding to the length of section 1, the drilling is stopped and the drills string is rotated in the opposite direction to the preceding direction of rotation.

When the drilling is horizontal drilling, the casing is forcibly held in position through the friction forces and is jammed in the ground. Unscrewing then raises no problem.

In the case where difficulties might be met with, particularly in the case of vertical drilling, for unscrewing the connection from the casing, the ring 3 is rotated in the drilling direction without causing the bottom motor driving the tool to operate. Thus, the ring 3 imprisoned in the ground can be readily jammed. With the casing thus immobilized, rotation of the drill string in the opposite direction allows the connection to be readily unscrewed.

After unscrewing of the connection, the drill string is removed from the well so as to leave in the well only the casing section whose end has a female thread. This thread subsequently allows different well treatment equipment to be connected to the casing, for example for cementing, perforation or acidification. This result is particularly advantageous, for it provides high accuracy in locating the level at which it is desired to work.

I claim:

1. A simultaneous drilling and casing device including a revolving table for use in drilling comprising, in combination:

a drill string means (11) rotatably driven by said revolving table and including hollow drill rods for conducting fluid;

a casing section (1) having an abrasive ring (3) at its leading end and having a rear end;

a portion (17, 18, 19, 20, 21) of said drill string means being received within said casing section (1);

a drive connection (10) between said drill string means and said rear end of said casing section (1) for rotating said casing section by said revolving table;

a motor (22) carried by said drill string portion within said casing section and driven by fluid conducted by said drill rods;

a drilling tool (28) connected to said motor (22) adjacent and in selected axially spaced relation to said abrasive ring (3) on said casing section;

said motor rotating said tool at a selected speed greater than the selected speed of said casing section and said abrasive ring;

means positioning said drilling tool (28) in said selected axial relation to said abrasive ring including an internal shoulder (2) on said casing section (1) spaced a selected distance from the end of said casing section;

and a stator portion (23) on said motor (22) including surfaces to abut said shoulder (2) to provide said selected axially spaced relation between said drilling tool (28) and said abrasive ring (3) on said casing section.

2. A simultaneous drilling and casing device for use in drilling comprising, incombination:

drill string means (11) adapted to be rotated at a selected speed and including hollow drill rods for conducting fluid;

a casing section (1) having an abrasive ring (3) at its leading end and having a rear end;

a portion (17, 18, 19, 20, 21) of said drill string means being received within said casing section (1);

a drive connection (10) between said drill string means and said rear end of said casing section (1);

a motor (22) carried by said drill string portion within said casing section and driven by fluid conducted by said drill rods;

a drilling tool (28) connected to said motor (22) adjacent and in sealed spaced relation to said abrasive ring (3) on said casing section;

said motor rotating said tool at a selected speed greater than the selected speed of casing section and abrasive ring;

means positioning said drilling tool (28) in said selected relation to said abrasive ring including an internal shoulder (2) on said casing section (1) intermediate ends of said casing section;

and a stator portion (23) on said motor (22) including surfaces to abut said shoulder (2) to provide said selected relation between said drilling tool (28) and said abrasive ring (3) on said casing section;

at least one sleeve (21) of resilient material positioned in said drill string means between said drive connection (10) and said motor (22), said sleeve (21) having an outer diameter for frictional engagement with said casing section to supplemental torque transmission from said drill string to said casing section.

3. In a simultaneous drilling and casing device including a rotatable casing section means having interior surfaces, a drill string means having a drill string portion receivable within said casing section means, and abrasive ring means at the leading end of said casing section means, said drill string portion being connected to a motor means for driving a drilling tool adjacent to and radially inwardly of said abrasive ring means, the improvement comprising in combination therewith;

means for transmitting torque from said rotatable drill string means to said casing section means for rotation of said casing section means and said abrasive ring means at a selected RPM;

said torque transmitting means including a drive connection means between one end of said rotatable casing section means and said drill string means, and resilient sleeves in frictional contact with said interior surfaces of said casing section means and carried by said drills string portion between said drive connection means and said motor means for supplementing torque transmitted by said drive connection means to said casing section means;

said motor means being carried by and connected to said drilling string portion between said drilling tool and said resilient sleeves and driving said drilling tool independently of said abrasive ring means at a selected RPM different than the selected RPM of said abrasive ring means.

4. A device as claimed in claim 3 wherein said drill string means includes a jar means between said drive connection means and said resilient sleeves;

longitudinally extending ribs on a non-rotating part of said motor means between said drive connection means and said drilling tool;

and a shoulder on said casing section means for seating of one of the ends of said ribs during assembly of said casing section means, drill string means, and motor means for positive positioning of said drilling tool axially with respect to said abrasive ring.

5. In a method of simultaneously drilling and positioning a casing section in a hole wherein there is provided a drill string, a casing section having an abrasive ring at its leading end, a drive connection between said drill string and a rear end of said casing section, a motor carried by said drill string in selected spaced relation to said abrasive ring, the steps of:

providing said drive connection between said drill string and said casing section for rotating said casing section and abrasive ring at a selected relatively slow rate of speed, said casing section being subjected to the imposition of torque stresses along its length between said drive connection and said abrasive ring;

supplementing transmission of torque forces from said drill string to said casing section along a portion of the length of said casing section above said motor means;

spacing said drill tool axially forwardly of said abrasive ring;

separately rotating said drill tool by said motor means at a selected relatively greater speed than the rotation of said casing section and abrasive ring by said drill string whereby the risk of collapse of unstable ground in the space separating the drilling tool and abrasive ring is reduced to a minimum.

6. An apparatus for simultaneously drilling and positioning a casing section in a hole, the apparatus including a revolving table;

the combination of:

a drill string rotatably driven by said revolving table;

a casing section having an abrasive ring at its leading end;

means providing a drive connection between said drill string and said casing section for rotating said casing section and abrasive ring at a selected relatively slow rate of speed imparted to the casing section by said drills string and revolving table;

said casing section being subjected to the imposition of torque stresses along its length between said drive connection and said abrasive ring;

means supplementing transmission of torque forces from said drill string to said casing section along a portion of the length of said casing section;

a motor carried by said drill string in selected spaced relation to said abrasive ring;

a drill tool carried by and connected to said motor in axially spaced forward relation to said abrasive ring;

said motor rotating said drill tool independently of rotation of said abrasive ring and at a selected relatively greater speed than the rotation of said abrasive ring whereby the risk of collapse of unstable ground in the space separating the drilling tool and abrasive ring is reduced.

* * * * *